US010362817B2

(12) United States Patent
Arzu

(10) Patent No.: US 10,362,817 B2
(45) Date of Patent: Jul. 30, 2019

(54) MULTI-USE GARMENT

(71) Applicant: Isadora Arzu, Lawrenceville, GA (US)

(72) Inventor: Isadora Arzu, Lawrenceville, GA (US)

( * ) Notice: Subject to any disclaimer, the term of this patent is extended or adjusted under 35 U.S.C. 154(b) by 181 days.

(21) Appl. No.: 14/990,980

(22) Filed: Jan. 8, 2016

(65) Prior Publication Data

US 2016/0255886 A1 Sep. 8, 2016

Related U.S. Application Data

(60) Provisional application No. 62/176,861, filed on Mar. 2, 2015.

(51) Int. Cl.

| | |
|---|---|
| ***A41B 13/00*** | (2006.01) |
| ***A41D 15/04*** | (2006.01) |
| ***A41B 13/06*** | (2006.01) |
| ***A47G 9/06*** | (2006.01) |
| ***A47G 9/08*** | (2006.01) |

(52) U.S. Cl.

CPC ..... *A41D 15/04* (2013.01); *A41B 13/00* (2013.01); *A41B 13/005* (2013.01); *A41B 13/06* (2013.01); *A47G 9/06* (2013.01); *A47G 9/083* (2013.01); *A47G 9/066* (2013.01)

(58) Field of Classification Search

CPC ..... A41B 13/00; A41B 13/005; A41B 13/06; A41D 11/00; A41D 1/12; A41D 15/00; A41D 15/002; A41D 15/007; A41D 15/04

See application file for complete search history.

(56) References Cited

U.S. PATENT DOCUMENTS 560,683 A * 5/1896 Bruckner ..... A41D 15/002 2/227
2,226,066 A * 12/1940 Moe ..... A41D 27/10 2/270
3,214,771 A * 11/1965 Treiber ..... A41D 19/0041 2/270
3,812,539 A * 5/1974 Muehlberg ..... A41D 10/00 2/69.5
4,347,629 A * 9/1982 Itoi ..... A41D 3/00 2/108
4,390,996 A * 7/1983 Read ..... A41D 3/06 2/70
4,773,100 A * 9/1988 Kuo ..... A41D 3/06 2/159
5,367,709 A * 11/1994 Teasley ..... A41D 15/002 2/69
5,560,043 A * 10/1996 Armstrong ..... A41D 3/00 2/69.5
5,722,094 A * 3/1998 Ruefer ..... A41B 13/06 2/69
D402,439 S * 12/1998 Marks ..... D2/756
(Continued)

*Primary Examiner* — Khaled Annis

(57) ABSTRACT

Disclosed is a multi-use garment including each of a torsal portion, a pair of sleeve portions attached to the torsal portion and a pair of leg portions attached to the torsal portion. The torsal portion may be configured to be worn over a torso. Further, each sleeve portion may be configured to accommodate at least a part of an arm. Furthermore, each leg portion may be configured to accommodate at least a part of a leg. Additionally, the multi-use garment may include a pair of fasteners attached to one or more of the torsal portion and the pair of leg portions. Further, each fastener may be configured to create a closed end.

9 Claims, 16 Drawing Sheets

(56) References Cited

U.S. PATENT DOCUMENTS

| | | | | |
|---|---|---|---|---|
| 6,336,226 | B1 * | 1/2002 | Garcia | A41D 15/04 2/227 |
| 6,981,282 | B2 * | 1/2006 | Marty | A41D 10/00 2/69 |
| 8,904,580 | B1 * | 12/2014 | Christensen | A41B 13/06 2/69.5 |
| 2009/0019616 | A1 * | 1/2009 | Smith | A41D 13/02 2/51 |
| 2010/0299802 | A1 * | 12/2010 | Bailey | A41B 13/005 2/70 |
| 2014/0331381 | A1 * | 11/2014 | Arajakis | A41D 3/005 2/84 |
| 2015/0059049 | A1 * | 3/2015 | Jaggernauth | A41B 13/08 2/80 |

* cited by examiner

MULTI-USE GARMENT

RELATED APPLICATIONS

Under the provisions of 35 U.S.C. § 119(e), this application claims priority from provisional patent application No. 62/176,861, filed on "Slumber Jammies Descriptions" which is incorporated herein by reference in its entirety.

It is intended that each of the referenced applications may be applicable to the concepts and embodiments disclosed herein, even if such concepts and embodiments are disclosed in the referenced applications with different limitations and configurations and described using different examples and terminology.

FIELD OF THE INVENTION

The invention generally relates to garments. More specifically, the invention relates to a multi-use garment and a multi-use blanket.

BACKGROUND

Garments generally serve the purpose of covering a person's body. Further, depending on a context of use, a garment may be specially designed to provide special functionalities. For example, a garment intended for use as a night dress may be designed to provide increased comfort level to the wearer while also being easy to wear and remove.

However, functionalities that are not conventionally associated with garments may be absent in existing garments. Accordingly, other objects providing these functionalities may be required. As a result, a user wishing to avail all such functionalities together may need to possess multiple objects. For instance, a user who may be traveling or camping may carry multiple objects such as a pajama, a storage bag, a sleeping bag, blanket etc.

Therefore, there is a need for a multi-use garment that may be configured to provide multiple functionalities.

BRIEF OVERVIEW

Disclosed is a multi-use garment including each of a torsal portion, a pair of sleeve portions attached to the torsal portion and a pair of leg portions attached to the torsal portion. The torsal portion may be configured to be worn over a torso. Further, each sleeve portion may be configured to accommodate at least a part of an arm. Furthermore, each leg portion may be configured to accommodate at least a part of a leg.

Additionally, the multi-use garment may include a pair of fasteners attached to one or more of the torsal portion and the pair of leg portions. Further, each fastener may be configured to create a closed end. In some embodiments, a fastener of the pair of fasteners may be one or more of a zipper, a snap button fastener and a Velcro fastener.

In some embodiments, each fastener may be configured to create a closed end at a part of the leg portion. For instance, the part of the leg portion may include a bottom part of the leg portion. Further, each fastener may be attached to the bottom part of each leg portion.

In some embodiments, each leg portion may be configured to be drawn into an inner space of the torsal portion. The inner space may be formed in between a front part of the torsal portion and a rear part of the torsal portion.

In some embodiments, each fastener may be configured to be fastened subsequent to drawing a corresponding leg portion into the inner space of the torsal portion.

In some embodiments, the multi-use garment may be configured for use as one or more of a storage bag and a sleeping bag, upon fastening each fastener of the pair of fasteners.

In some embodiments, the torsal portion may include each of a front part and a rear part. Further, one or more of the front part and the rear part may include a fastener. Furthermore, in some embodiments, the rear part may include the fastener.

Additionally, one end of the fastener may be located at an upper periphery of the rear part. Moreover, in some embodiments, the fastener may be a zipper.

In some embodiments, the multi-use garment may further include one or more drawstrings. Further, a size of the torsal portion may be based on a state of the one or more drawstrings.

In some embodiments, the multi-use garment may include a pair of drawstrings. Further, each drawstring may be located along a side of the torsal portion. Furthermore, a length of the torsal portion along the side may be based on a state of the corresponding drawstring.

In some embodiments, the multi-use garment may further include each of one or more belts and one or more buttons attached to the torsal portion. Further, the one or more belts may include one or more holes configured to fasten the one or more belts with the one or more buttons. Furthermore, a size of the torsal portion may be based on fastening of the one or more belts to the one or more buttons.

In some embodiments, the multi-use garment may further include one or more pockets attached to an outer surface of one or more of a front part of the torsal portion and a rear part of the torsal portion. Further, in some embodiments, the multi-use garment may further include a collar portion.

Also disclosed is a multi-use blanket including a pouch configured to accommodate an infant. The pouch may be attached to a front part of the blanket. Further, the multi-use blanket may include a pocket attached to a front part of the pouch. The pocket may be configured to accommodate one or more objects. In some embodiments, the pocket may be configured to accommodate a burp cloth.

Additionally, the multi-use blanket may include a hook attached to the blanket. The hook may be configured to hang a pacifier. In some embodiments, the hook may be attached to one or more of the pouch and the pocket.

In some embodiments, the multi-use blanket may further include a pair of safety wrap flaps. Further, a first end of each safety wrap flap may be attached to the front part of the blanket. Additionally, the pouch may include a pair of openings. An opening may be configured to receive a second end of a safety wrap flap. Further, the multi-use blanket may include a fastener configured to fasten the second end of a first safety wrap flap with the second end of a second safety wrap flap.

In some embodiments, the multi-use blanket may further include a pocket attached to a front part of one or more of the first safety wrap flap and the second safety wrap flap. Further, the pocket may be configured to accommodate one or more objects.

In some embodiments, the multi-use blanket may include a diaper attached to a front part of the multi-use blanket. The diaper may include each of a center fold, a left fold, a right fold, a right leg opening, a left leg opening and a fastener configured to fasten the left fold to the right fold. The fastener may be one of a Velcro fastener and snap-button based fastener.

Both the foregoing brief overview and the following detailed description provide examples and are explanatory only. Accordingly, the foregoing brief overview and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the Applicant. The Applicant retains and reserves all rights in its trademarks and copyrights included herein, and grants permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure. In the drawings.

DETAILED DESCRIPTION

Figure 1:
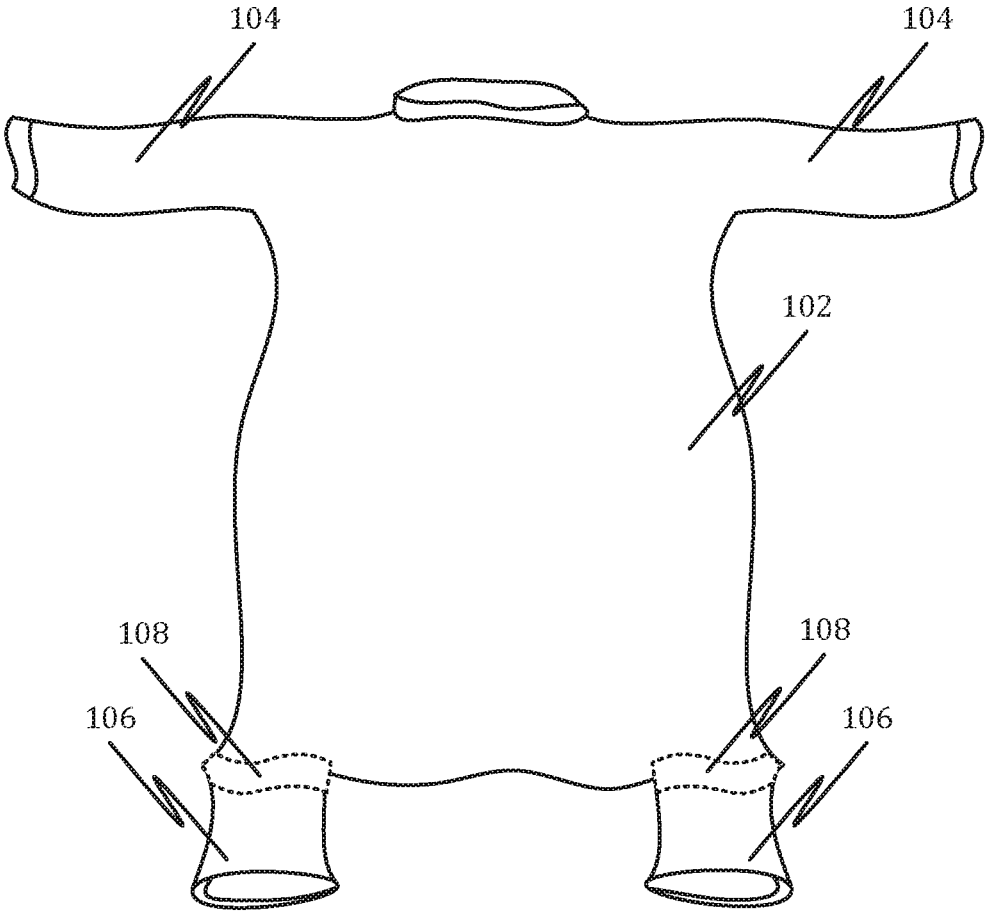
FIG. 1 illustrates a multi-use garment according to various embodiments.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Regarding applicability of 35 U.S.C. § 112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

The present disclosure includes many aspects and features. Moreover, while many aspects and features relate to, and are described in, the context of film production, embodiments of the present disclosure are not limited to use only in this context.

Overview

The present disclosure relates to a multi-use garment called "Slumber Jammies" that may be used by children, adults and newborns. Slumber Jammies has a shape of a bag and is configured to be changed for use as pajamas, a sleeping bag or a storage bag. Accordingly, Slumber Jammies may be used for travel, camping, slumber parties, and generally keeping wearers warm at home.

The Slumber Jammies includes a pair of big long sleeve portions that provides comfort to the wearer. Further, a long zipper is provided at the rear part of the Slumber Jammies that makes it easy to wear.

Additionally, Slumber Jammies may include a pair of leg portions. In some cases, a length of the leg portions may be sufficient to cover the legs of the wearer up to the ankles. Further, a pair of zippers may be provided at the bottom of the leg portions. In one instance, closing the pair of zippers may provide warmth to the feet of the wearer. In another instance, by pulling the leg portions inwards into a torsal portion of the Slumber Jammies and closing the pair of zippers, the Slumber Jammies may be converted into a sleeping bag.

Further, the Slumber Jammies may be configured to be changed in size. For instance, the Slumber Jammies may include a pair of strings provided at either sides of the torsal portion. By pulling the pair of strings, the Slumber Jammies may be made long or short.

Further, the Slumber Jammies may include big pockets or pouches for storage. The pockets may be situated either on the front part or the rear part of the Slumber Jammies. Additionally, the pockets may situated on the inner side of either the front part or the rear part. Further, the pockets may be of different shapes and embellishments. As a result, Slumber Jammies may be used for packing essentials or toiletries in the pockets, be folded and taken during travel.

In some instances, the Slumber Jammies for newborns or infants may be in the form of a blanket with a pocket or a pouch. In some instances, the pocket may be in the form of a wrap. In some other instances, the pocket may be in the form of a bag attached to the blanket. Further, the pocket may include a fastener such as a Velcro or a zipper or a snap button. Additionally, the pocket may be adjustable to keep the infant snuggled, warm, and cozy. Furthermore, the pocket may be in the form of a folded pouch that may be attached to the blanket with Velcro or snap buttons. Accordingly, the pocket may be removable. Alternatively, in some instances, the pocket may be permanently fastened to the blanket and therefore may not be removable from the blanket.

Furthermore, as the infant grows, the Slumber Jammies may be used as a storage bag to store stuffed animals.

FIG. 1 illustrates a multi-use garment 100 according to some embodiments. The multi-use garment 100 may be configured to be changed for use as pajamas, a sleeping bag or a storage bag. Accordingly, the multi-use garment 100 may be useful for travel, camping, slumber parties and regular night wear. Further, the multi-use garment 100 may be of different sizes so as to be comfortably worn by adults, children or infants. Additionally, in some embodiments, the multi-use garment 100 may be configured to be worn by persons of a particular gender. Alternatively, in some embodiments, the multi-use garment 100 may be of a unisex type. Furthermore, the multi-use garment 100 may be of different designs, patterns and colors.

In various embodiments, the multi-use garment 100 may be made from one or more types of fabrics. The fabrics may be woven or non-woven. Examples of fabrics include, but are not limited to, cotton, silk, polyester, rayon and nylon. In some embodiments, the multi-use garment 100 may be made from a soft, pliable material, such as a knitted cotton material, a knitted fleeced material or lightweight woven material.

Further, the multi-use garment 100 may be made from one or more layers of fabrics. For instance, using multiple layers of fabrics may provide an increased level of comfort and warmth to the wearer. In some embodiments, multiple layers of the same fabric type may be used to form the multi-use garment 100. In some other embodiments, multiple layers of different fabric types may be used. As a result of using multiple layers, strength of the multi-use garment 100 may be improved. Consequently, the multi-use garment 100 may offer protection to the wearer from sharp objects such as, for example, thorns while being used outdoors.

Furthermore, multiple layers of different types of fabrics may be used in order to provide different functionalities. For example, an inner layer configured to be in contact with the skin of a wearer may be moisture absorbent, while an outer layer configured to be exposed to the environment may be water repellent. As a result, the skin of wearer may be kept substantially dry by absorbing sweat and by not allowing water from the environment to come in contact with the skin. As a result, a comfort level of the wearer may be greatly increased.

Further, in some embodiments, the fabric used to form the multi-use garment 100 may be breathable. As a result, a wearer may be able to breathe even if a respiratory opening of the wearer such as nose or mouth were covered by the multi-use garment 100. Accordingly, a risk of suffocation may be mitigated. As a result, the use of a breathable fabric may allow the multi-use garment 100 to safely function as a sleeping bag or a blanket.

Additionally, in some embodiments, the fabric may have antimicrobial properties. For example, an inner layer of the multi-use garment 100 configured to be in contact with the skin of a wearer may include antibacterial agents such as silver ions. As a result, bacterial growth over the skin or in the inner layer may be inhibited. Further, deodorization of sweat formed over the skin may also be facilitated.

Furthermore, in some embodiments, the fabric may have insect repellent properties. For example, an outer layer of the multi-use garment 100 configured to be exposed to the environment may be impregnated with an insect repellent. As a result, protection from insects such as mosquitoes may be provided to the wearer of the multi-use garment 100 when used, for example, in outdoor environments such as camps.

In order to facilitate wearing, the multi-use garment 100 may include each of a torsal portion 102, a pair of sleeve portions 104 and a pair of leg portions 106.

The torsal portion 102 may be configured to be worn over a torso of the wearer. In some embodiments, the torsal portion 102 may be configured to completely cover the torso. Alternatively, in some embodiments, may be configured to partially cover the torso. Further, in some embodiments, the torsal portion 102 may be configured in such a way that the multi-use garment may be worn by a wearer with a front part of the torsal portion 102 covering the front part of the torso in one instance and the front part of the torsal portion 102 covering the rear part of the torso in another instance. As a result, in some embodiments, the wearer may easily wear the multi-use garment without paying attention to match the front or rear part of the torsal portion 102 to cover a corresponding part of the torso.

Further, the pair of sleeve portions 104 may be attached to the torsal portion 102. In some embodiments, a sleeve portion 104 may be attached to the torsal portion 102 by performing one or more fastening operations such as, for example, but not limited to, sewing, knitting, weaving and gluing. Further, in some embodiments, the sleeve portion 104 may be removably attached to the torsal portion 102 using a fastener such as, for example, a Velcro fastener. As a result, a sleeve portion 104 may be detached from the torsal portion 102.

Each sleeve portion 104 may be configured to accommodate at least a part of an arm. In some embodiments, a length of the sleeve portion 104 may be such that the arm of the wearer may be covered by the sleeve portion 104 till the wrist. In some other embodiments, a length of the sleeve portion 104 may be such that the arm of the wearer may be covered till elbow. In yet other embodiments, a length of the sleeve portion 104 may be such that the entire arm of the wearer including the hand may be covered by the sleeve portion 104. Further, in some embodiments, a width of the sleeve portion 104 may be such that the arm may be loosely covered by the sleeve portion 104. As a result, a wearer may easily insert an arm into the sleeve portion 104 while wearing and easily remove the arm from the sleeve portion 104 while removing the multi-use garment 100. Additionally, a larger width of the sleeve portion 104 may provide a greater comfort to the wearer while the multi-use garment is worn.

In some embodiments, a material used to form the sleeve portion 104 may be of same fabric as that of the torsal portion 102. Alternatively, in some other embodiments, the sleeve portion 104 may be formed of a material or fabric different from that of the torsal portion 102. For example, in order provide greater warmth, the torsal portion 102 may be formed of a multi-layered fabric. However, the sleeve portion 104 may be formed using a single layered fabric that may provide greater movability of an arm covered by the sleeve portion 104.

Further, the pair of leg portions 106 may be attached to the torsal portion 102. In some embodiments, a leg portion 106 may be attached to the torsal portion 102 by performing one or more fastening operations such as, for example, but not limited to, sewing, knitting, weaving and gluing. Further, in some embodiments, the leg portion 106 may be removably attached to the torsal portion 102 using a fastener such as, for example, a Velcro fastener. As a result, a leg portion 106 may be detached from the torsal portion 102.

Furthermore, each leg portion 106 may be configured to accommodate at least a part of a leg. Accordingly, each leg portion 106 may include an opening at the bottom part of the leg portion 106 through which a leg, including foot, may pass. In some embodiments, a length of the leg portion 106 may be such that the leg of the wearer may be covered by the leg portion 106 till the ankle. In some other embodiments, a length of the leg portion 106 may be such that the leg of the wearer may be covered till the knee. In yet other embodiments, a length of the leg portion 106 may be such that the entire leg of the wearer including the feet may be covered by the leg portion 106.

Figure 10:
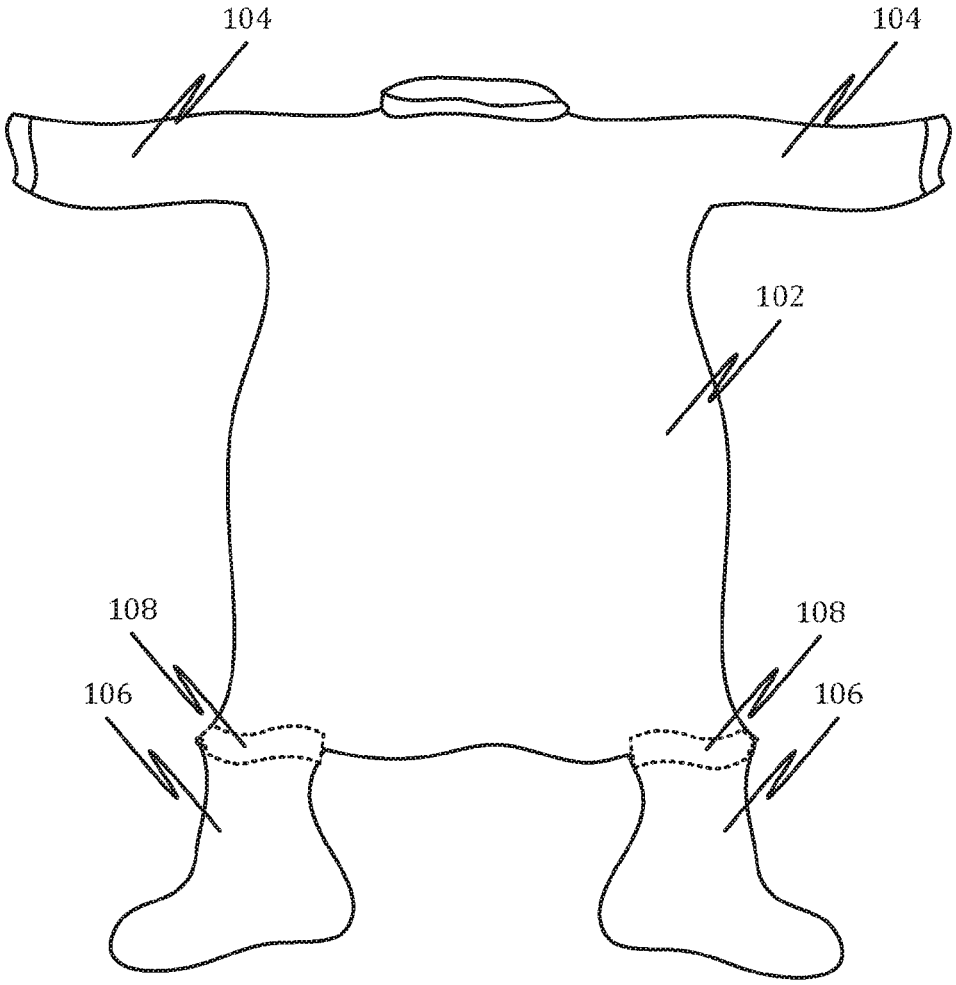
FIG. 10 illustrates a multi-use garment including a pair of leg portions covered at the lower part according to various embodiments.

Furthermore, a lower part of each leg portion 106 may be configured to cover at least a part of a foot of the wearer. In some embodiment, the lower part of each leg portion 106 may be configured to completely cover the foot of the wearer. For instance, as exemplarily illustrated in FIG. 10, the lower part of each leg portion 106 may be shaped in the form of a sock in order to provide comfort and warmth to the feet of the wearer.

Further, in some embodiments, a width of the leg portion 106 may be such that the leg may be loosely covered by the leg portion 106. As a result, a wearer may easily insert a leg into the leg portion 106 while wearing and easily remove the leg from the leg portion 106 while removing the multi-use garment 100. Additionally, a larger width of the leg portion 106 may provide a greater comfort to the wearer while the multi-use garment is worn.

In some embodiments, a material used to form the leg portion 106 may be of same fabric as that of the torsal portion 102. Alternatively, in some other embodiments, the leg portion 106 may be formed of a material or fabric different from that of the torsal portion 102. For example, in order provide greater warmth, the torsal portion 102 may be formed of a multi-layered fabric. However, the leg portion 106 may be formed using a single layered fabric that may provide greater movability of a leg covered by the leg portion 106.

Figure 2:
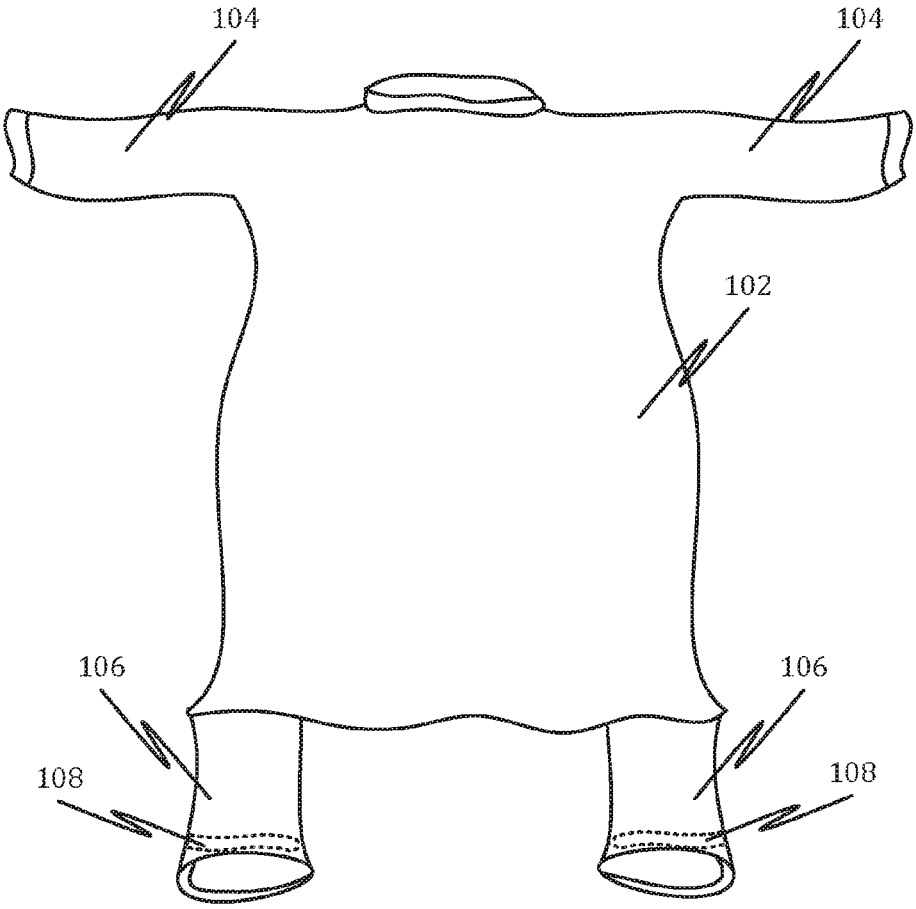
FIG. 2 illustrates a multi-use garment according to various embodiments.

Additionally, the multi-use garment 100 may include a pair of fasteners 108 attached to one or more of the torsal portion 102 and the pair of leg portions 106. In some embodiments, as illustrated in FIG. 1, the pair of fasteners 108 may be attached to the torsal portion 102. In some other embodiments, the pair of fasteners 108 may be attached to the pair of leg portions 106. For instance, as illustrated in FIG. 2, the pair of fasteners 108 may be attached to a bottom portion of the pair of leg portions 106.

Further, each fastener 108 may be configured to create a closed end. A fastener 108 of the pair of fasteners 108 may be one or more of a zipper, a snap button fastener and a Velcro fastener. In some embodiments, each fastener 108 may be configured to create a closed end at a part of the leg portion 106. For instance, the part of the leg portion 106 may include a bottom part of the leg portion 106. Further, each fastener 108 may be attached to the bottom part of each leg portion 106 as exemplarily illustrated in FIG. 2. As a result, fastening of the pair of fasteners 108 may prevent a wearer of the multi-use garment from extending legs, including feet, beyond an opening of the leg portions 106. In other words, the closed ends created by fastening the pair of fasteners 108 may result in the legs of the wearer being completely covered and enclosed by the leg portions 106. Accordingly, the feet of the wearer may be kept warm.

In some embodiments, each fastener 108 may be configured to create a closed end at a part of the torsal portion 102. For instance, as illustrated in FIG. 1, the pair of fasteners 108 may create closed ends at the part of the torsal portion 102 proximal to the pair of leg portions 106. Accordingly, when the pair of fasteners 108 is fastened, the closed ends created may prevent a wearer from inserting legs into the pair of leg portions. In other words, fastening the pair of fasteners 108 may convert the torsal portion 102 into a bag.

Figure 3:
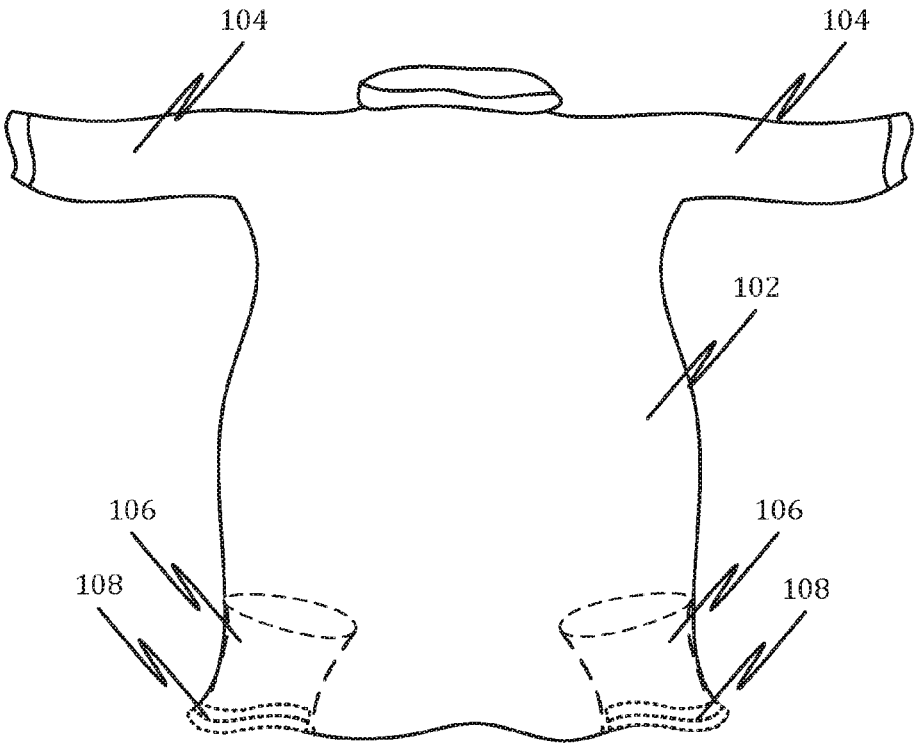
FIG. 3 illustrates a view of a multi-use garment when the pair of leg portions is drawn into the inner space of the torsal portion according to various embodiments.

In some embodiments, each leg portion 106 may be configured to be drawn into an inner space of the torsal portion 102. The inner space may be formed in between a front part of the torsal portion 102 and a rear part of the torsal portion 102. Further, in some embodiments, each fastener 108 may be configured to be fastened subsequent to drawing a corresponding leg portion 106 into the inner space of the torsal portion 102. For instance, as illustrated in FIG. 3, subsequent to drawing the leg portions 106 into the inner space of the torsal portion 102 and fastening the pair of fasteners 108, the multi-use garment may be in the form of a bag. Accordingly, the multi-use garment may be configured for use as one or more of a storage bag and a sleeping bag, upon fastening each fastener of the pair of fasteners 108.

Figure 4:
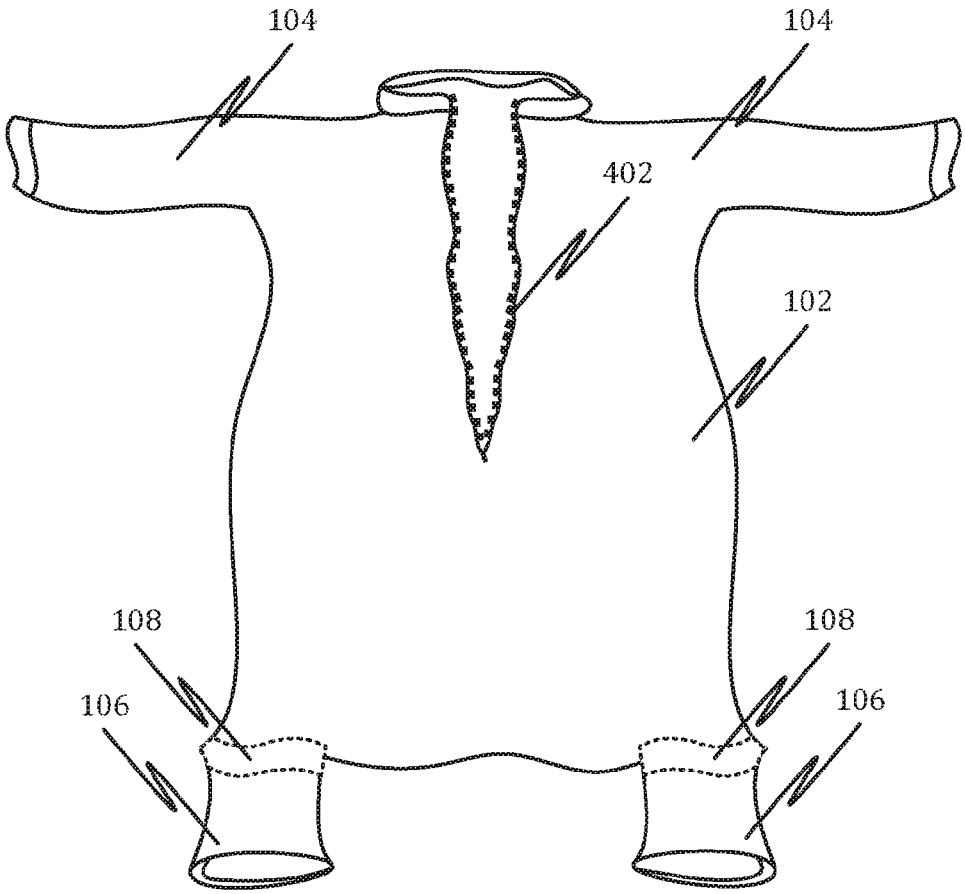
FIG. 4 illustrates a rear view of a multi-use garment depicting a fastener included on the rear part of the torsal portion according to various embodiments.

In some embodiments, one or more of the front part and the rear part of the torsal portion 102 may include a fastener. Furthermore, in some embodiments, the rear part may include the fastener. For instance, as illustrated in FIG. 4, the rear part of the torsal portion 102, may include a fastener 402. Additionally, one end of the fastener 402 may be located at an upper periphery of the rear part. Moreover, in some embodiments, the fastener may be a zipper. Accordingly, as illustrated, upon unfastening the fastener 402, the rear part of the torsal portion 102 may be split open allowing the multi-use garment 100 to be worn and removed easily.

Figure 5:
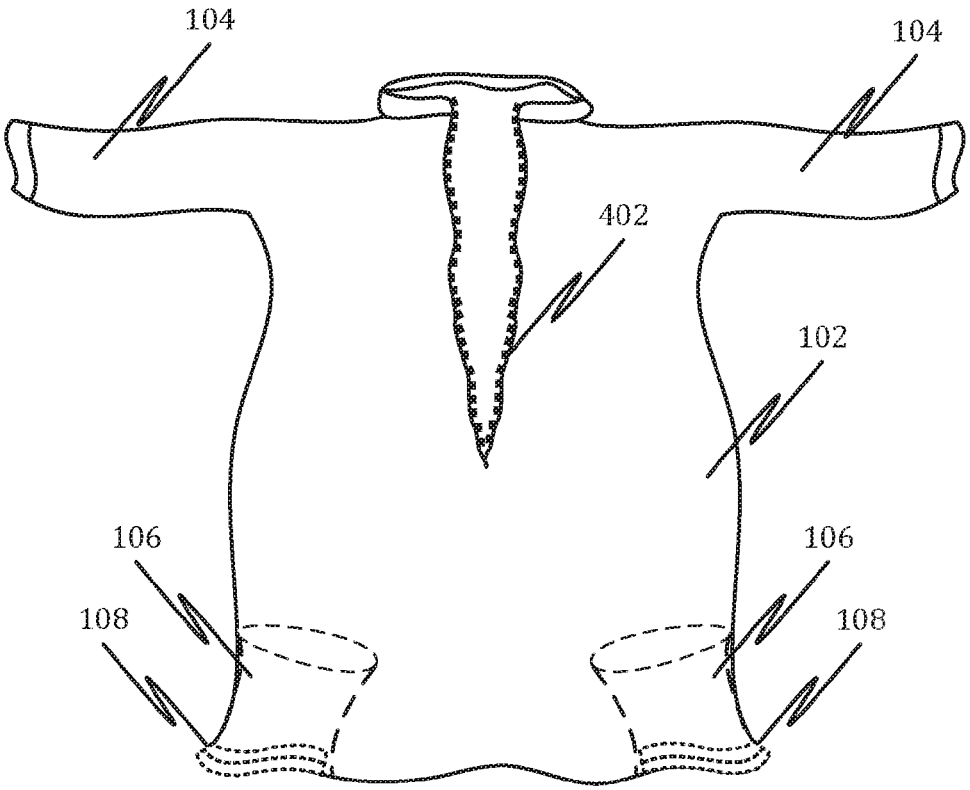
FIG. 5 illustrates a rear view of a multi-use garment depicting a fastener when the pair of leg portions is drawn into the inner space of the torsal portion according to various embodiments.
Figure 11:
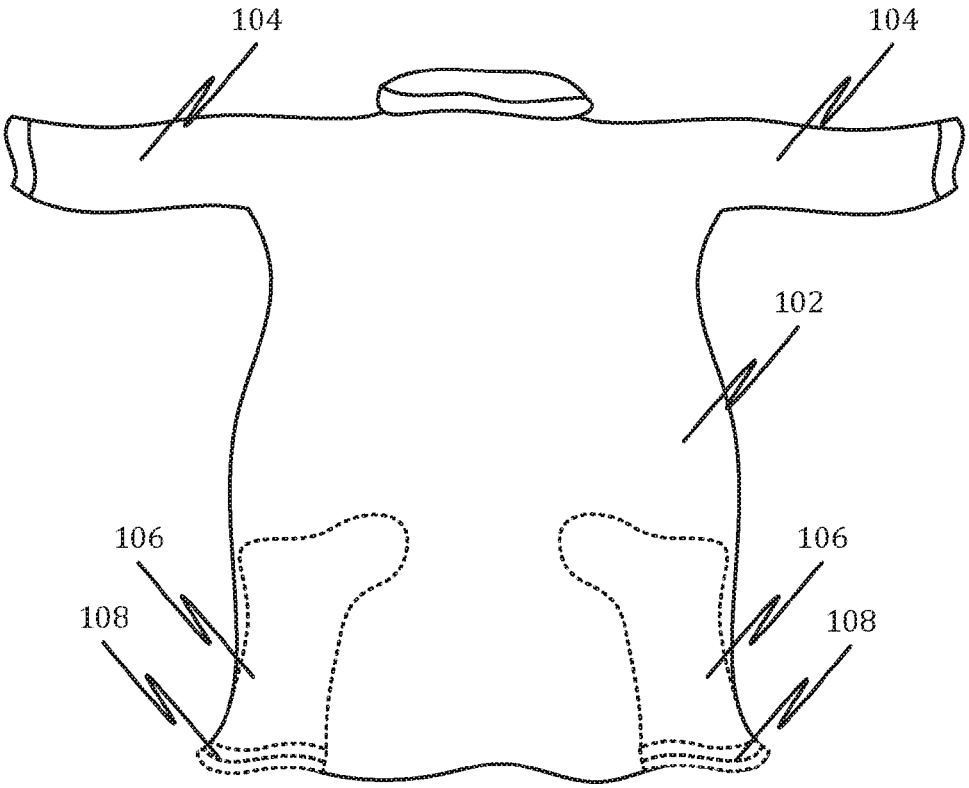
FIG. 11 illustrates a multi-use garment including a pair of leg portions covered at the lower part, when the pair of leg portions is drawn into the inner space of the torsal portion according to various embodiments.

Additionally, in some embodiments, the fastener 402 may facilitate use of the multi-use garment 100 as one or more of a storage bag and a sleeping bag. For instance, as illustrated in FIG. 5 and FIG. 11, when the pair of leg portions 106 is withdrawn into the inner space of the torsal portion 102 and the pair of fasteners 108 subsequently fastened, unfastening the fastener 402 may create a large opening in the upper part of the torsal portion 102. As a result, a user may easily insert objects such as, for example, clothes through the opening and store the objects within the inner space of the torsal portion 102.

In some embodiments, the multi-use garment 100 may further include one or more drawstrings. In general, the drawstring may enable a size of at least a part of the multi-use garment 100 to be adjusted. Accordingly, in various embodiments, the one or more drawstrings may be situated at different parts of the multi-use garment 100. In some instances, a drawstring of the one or more drawstrings may be situated at one or more of the torsal portion 102, the pair of sleeve portions 104 and the pair of leg portions 106.

In an instance, a pair of drawstrings may be situated at the bottom part of each of the leg portions 106. Accordingly, pulling the pair of drawstrings may tighten the bottom part of the leg portions 106 resulting in a firm fitting of the leg portions 106 around the legs of the wearer. Further, in some embodiments, the pair of drawstrings may function as fasteners configured to create a closed end at each of the leg portions 106. Accordingly, the drawstrings may facilitate use of the multi-use garment as one or more of a storage bag and a sleeping bag.

Similarly, in another instance, a pair of drawstrings may be situated at the outer part of each of the sleeve portions 104. Accordingly, pulling the pair of drawstrings may tighten the outer part of the sleeve portions 104 resulting in a firm fitting of the sleeve portions 104 around the arms of the wearer. Further, in some embodiments, the pair of drawstrings may function as fasteners configured to create a closed end at each of the sleeve portions 106.

In another instance, a pair of drawstrings may be situated along a longer dimension of each of the pair of leg portions 106. Accordingly, pulling the pair of drawings may result in a change in length of the leg portions 106. Similarly, in another instance, a pair of drawstrings may be situated along a longer dimension of each of the pair of sleeve portions 104. Accordingly, pulling the pair of drawings may result in a change in length of the sleeve portions 104.

Figure 6:
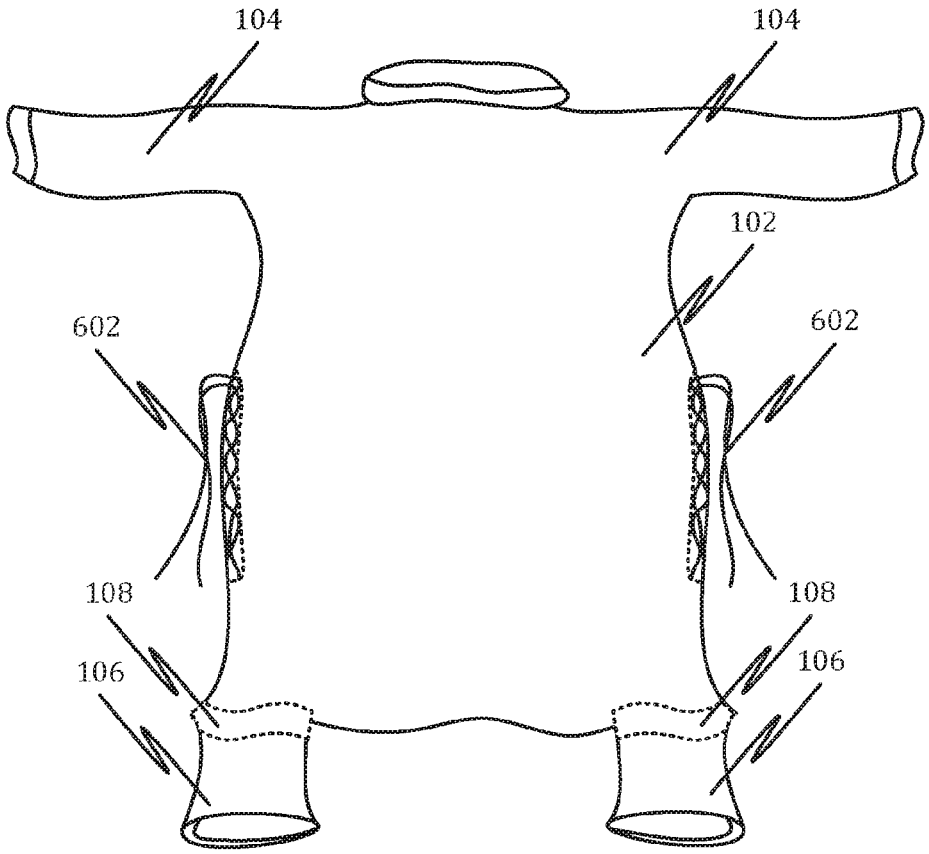
FIG. 6 illustrates a multi-use garment including a pair of drawstrings in accordance with various embodiments.

In some embodiments, the one or more drawstrings 602 may be situated along the sides of the torsal portion 102 as illustrated in FIG. 6. Further, a size of the torsal portion 102 may be based on a state of the one or more drawstrings 602. For instance, pulling the one or more drawstrings 602 may change a size of the torsal portion 102, by, for example, changing the length of the torsal portion 102 along the side.

Figure 7A:
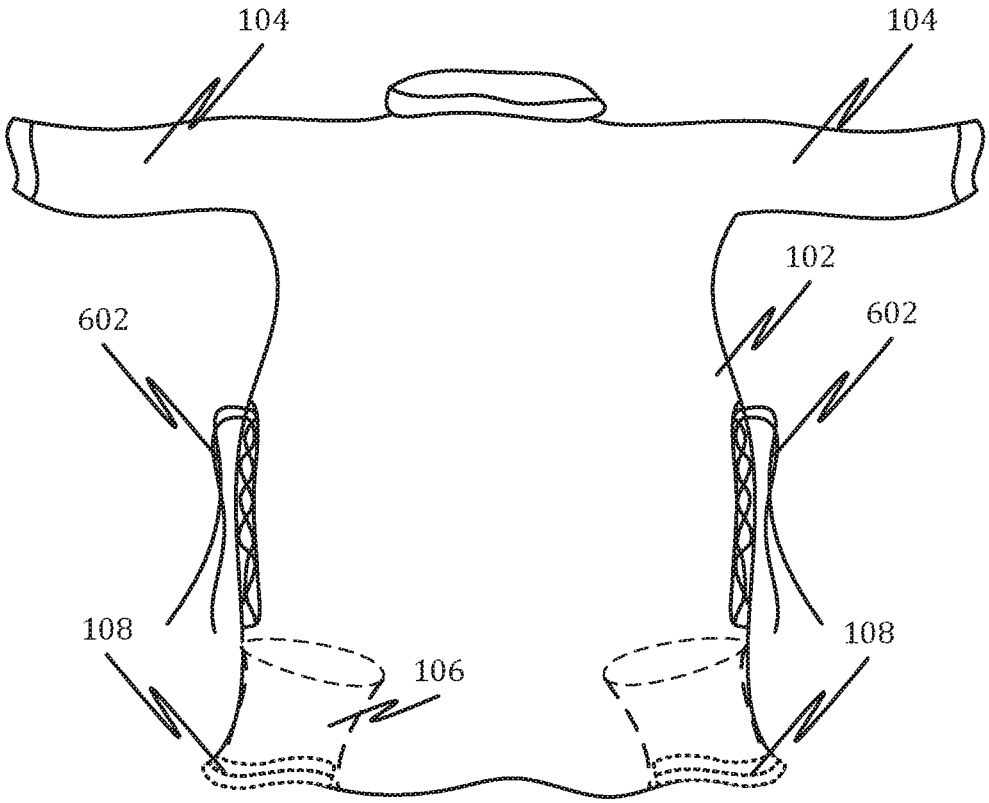
FIGS. 7A and 7B illustrate a multi-use garment including a pair of drawstrings when the pair of leg portions is drawn into the inner space of the torsal portion according to various embodiments.
Figure 7B:
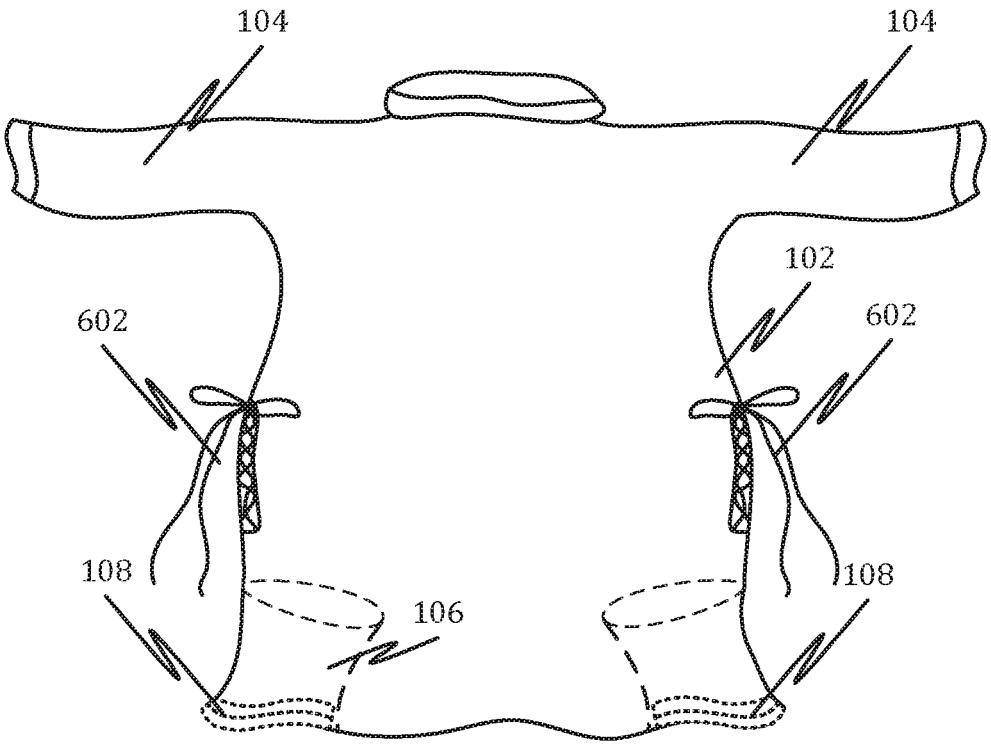

Additionally, in some embodiments, when the pair of leg portions 106 is withdrawn into the inner space of the torsal portion 102 and the pair of fasteners 108 subsequently fastened, the multi-use garment 100 may be used as one or more of a storage bag and a sleeping bag. Further, by pulling the one or more drawstrings 602, a size of one or more of the storage bag and the sleeping bag may be adjusted as illustrated in FIGS. 7A and 7B. As shown, the one or more drawstrings 602 may be pulled and tied into a knot such as, for example, a shoelace knot.

Figure 8:
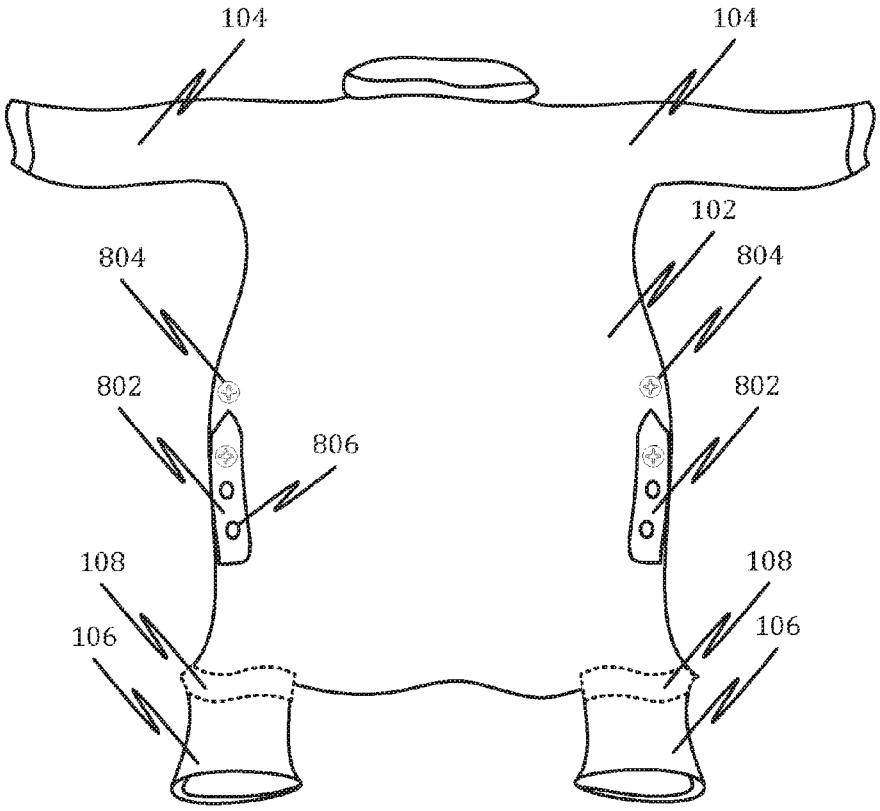
FIG. 8 illustrates a multi-use garment including a pair of belts in accordance with various embodiments.

In some embodiments, the multi-use garment may further include each of one or more belts 802 and one or more buttons 804 attached to the torsal portion 102 as exemplarily illustrated in FIG. 8. Further, the one or more belts may include one or more holes 806 configured to fasten the one or more belts 802 with the one or more buttons 804. Furthermore, a size of the torsal portion 102 may be based on fastening of the one or more belts 802 to the one or more buttons 804.

Figure 9:
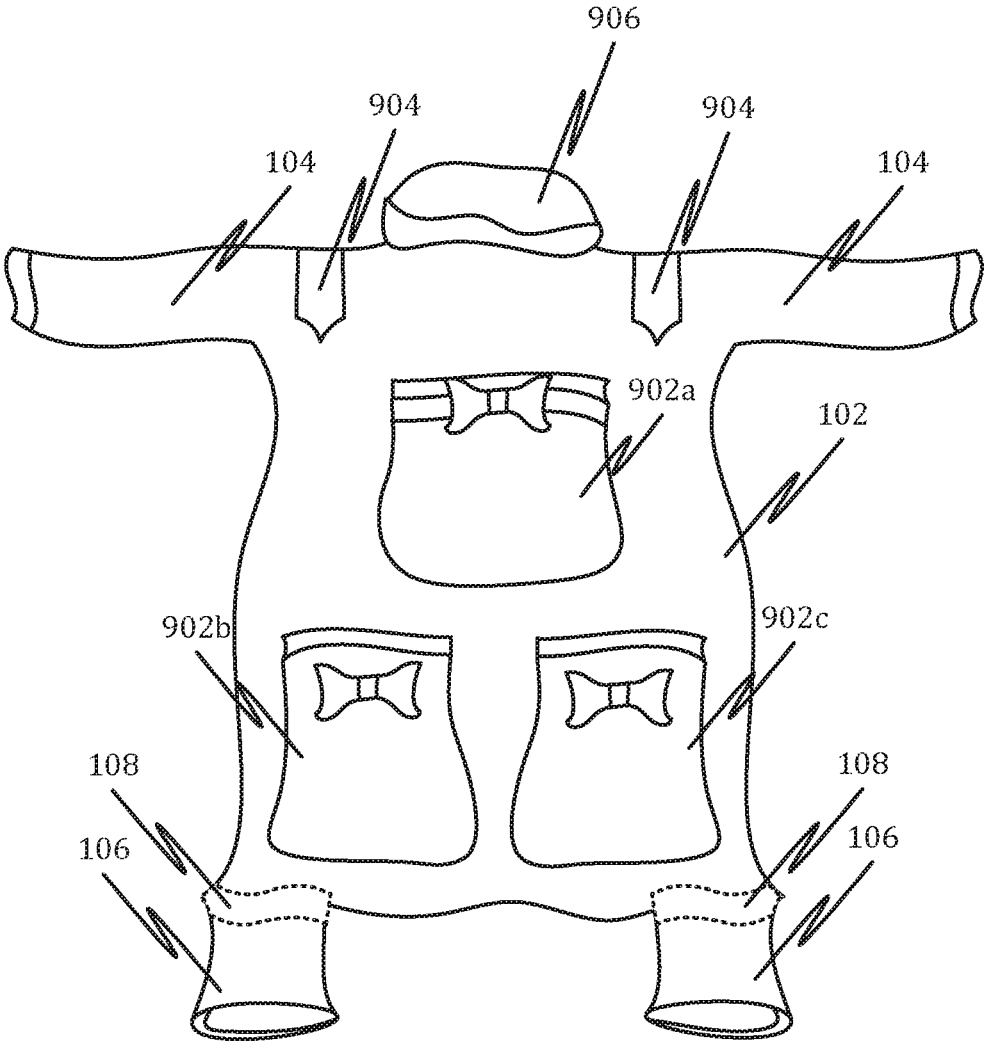
FIG. 9 illustrates a multi-use garment including one or more pockets in accordance with various embodiments.

In some embodiments, the multi-use garment 100 may further include one or more pockets 902 attached to an outer surface of one or more of a front part of the torsal portion 102 and a rear part of the torsal portion 102. For instance, as illustrated in FIG. 9, the front part of the torsal portion 102 may include one or more pockets 902, exemplarily illustrated as 902*a*, 902*b* and 902*c*. Furthermore, in some embodiments, the one or more pockets 902 may be attached to an inner surface of one or more of the front part of the torsal portion 102 and the rear part of the torsal portion 102.

The one or more pockets 902 may be configured to store one or more objects. For example, in some embodiments, the one or more pockets may be sufficiently large to function as a pouch for an infant. Accordingly, the one or more pockets 902 may be made from a soft fabric such as cotton.

Further, the one or more pockets 902 may be attached to the torsal portion 102. In some embodiments, the one or more pockets 902 may be attached to the torsal portion 102 by performing one or more fastening operations such as, for example, but not limited to, sewing, knitting, weaving and gluing. Further, in some embodiments, one or more pockets 902 may be removably attached to the torsal portion 102 using a fastener such as, for example, a Velcro fastener. As a result, one or more pockets 902 may be detached from the torsal portion 102.

Additionally, in some embodiments, the multi-use garment 100 may include one or more embellishments 904. For example, as illustrated in FIG. 9, an embellishment 904 may be provided on the torsal portion 102. Similarly, the one or more embellishments 904 may be provided on one or more of the sleeve portions 104, the leg portions 106 and the one or more pockets 902.

Further, in some embodiments, the multi-use garment 100 may further include a collar portion 906 as illustrated in FIG. 9. The collar portion 906 may be wide enough to accommodate a neck of the wearer. Further, in some embodiments, a hood (not shown in figure) may be attached the collar portion 906. The hood may be configured to cover at least a portion of the head of the wearer.

Figure 12:
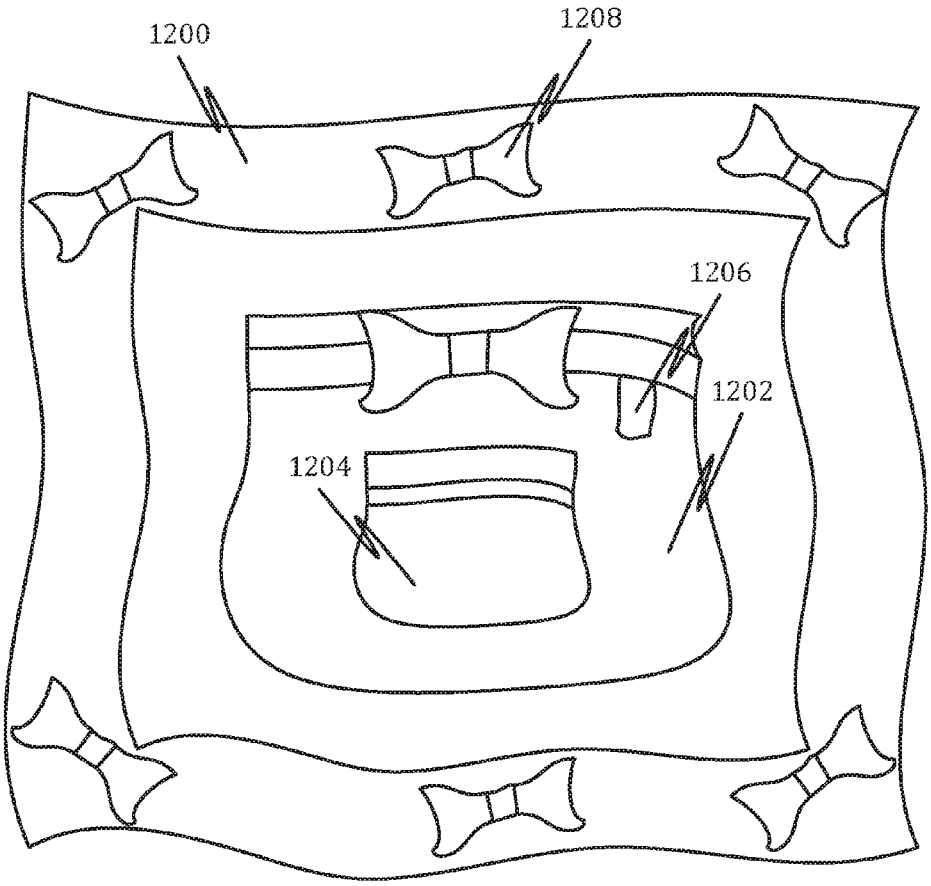
FIG. 12 illustrates a multi-use blanket including a pouch in accordance with various embodiments.

Also disclosed is a multi-use blanket 1200 including a pouch 1202 configured to accommodate an infant. As illustrated in FIG. 12, the pouch 1202 may be attached to a front part of the multi-use blanket 1200. In some embodiments, the pouch 1202 may be attached to the multi-use blanket 1200 by performing one or more fastening operations such as, for example, but not limited to, sewing, knitting, weaving and gluing. Further, in some embodiments, the pouch 1202 may be removably attached to the multi-use blanket 1200 using a fastener such as, for example, a Velcro fastener. As a result, in some embodiments, the pouch 1202 may be detached from the multi-use blanket 1200.

Further, the multi-use blanket 1200 may include a pocket 1204 attached to a front part of the pouch 1202. The pocket 1204 may be configured to accommodate one or more objects. In some embodiments, the pocket 1204 may be configured to accommodate a burp cloth.

In some embodiments, the pocket 1204 may be attached to the pouch 1202 by performing one or more fastening operations such as, for example, but not limited to, sewing, knitting, weaving and gluing. Further, in some embodiments, the pocket 1204 may be removably attached to the pouch 1202 using a fastener such as, for example, a Velcro fastener. As a result, in some embodiments, the pocket 1204 may be detached from the pouch 1202.

Additionally, the multi-use blanket 1200 may include a hook 1206 attached to the blanket. The hook 1206 may be configured to hang a pacifier (not shown in figure). In some embodiments, the hook 1206 may be attached to one or more of the pouch 1202 and the pocket 1204.

Further, in some embodiments, the multi-use blanket 1200 may include one or more embellishments 1208 to enhance aesthetic characteristics. The one or more embellishments 1208 may be provided over one or more parts of the multi-use blanket 1200 such as, for example, over the pouch 1202 or the pocket 1204. For instance, as illustrated, the one or more embellishments 1208 may be provided around the border of the multi-use blanket 1200.

In various embodiments, the multi-use blanket 1200 may be made from one or more types of fabrics. The fabrics may be woven or non-woven. Examples of fabrics include, but are not limited to, cotton, silk, polyester, rayon and nylon. In some embodiments, the multi-use blanket 1200 may be made from a soft, pliable material, such as a knitted cotton material, a knitted fleeced material or lightweight woven material.

Further, the multi-use blanket 1200 may be made from one or more layers of fabrics. For instance, using multiple layers of fabrics may provide an increased level of comfort and warmth to the wearer, such as for example, a child. In some embodiments, multiple layers of the same fabric type may be used to form the multi-use blanket 1200. In some other embodiments, multiple layers of different fabric types may be used. As a result of using multiple layers, strength of the multi-use blanket 1200 may be improved.

Furthermore, multiple layers of different types of fabrics may be used in order to provide different functionalities. For example, an inner layer configured to be in contact with the skin of a wearer may be moisture absorbent, while an outer layer configured to be exposed to the environment may be water repellent. As a result, the skin of wearer may be kept substantially dry by absorbing sweat and by not allowing water from the environment to come in contact with the skin. As a result, a comfort level of the wearer may be greatly increased.

Further, in some embodiments, the fabric used to form the multi-use blanket 1200 may be breathable. As a result, a wearer may be able to breathe even if a respiratory opening of the wearer such as nose or mouth were covered by the multi-use blanket 1200. Accordingly, a risk of suffocation may be mitigated. As a result, the use of a breathable fabric may allow the multi-use blanket 1200 to safely function as a blanket for an infant.

Additionally, in some embodiments, the fabric may have antimicrobial properties. For example, an inner layer of the multi-use blanket 1200 configured to be in contact with the skin of a wearer may include antibacterial agents such as silver ions. As a result, bacterial growth over the skin or in the inner layer may be inhibited. Further, deodorization of sweat formed over the skin may also be facilitated.

Furthermore, in some embodiments, the fabric may have insect repellent properties. For example, an outer layer of the multi-use blanket 1200 configured to be exposed to the environment may be impregnated with an insect repellent. As a result, protection from insects such as mosquitoes may be provided to the wearer of the multi-use blanket 1200 when used, for example, in outdoor environments such as camps.

Figure 13:
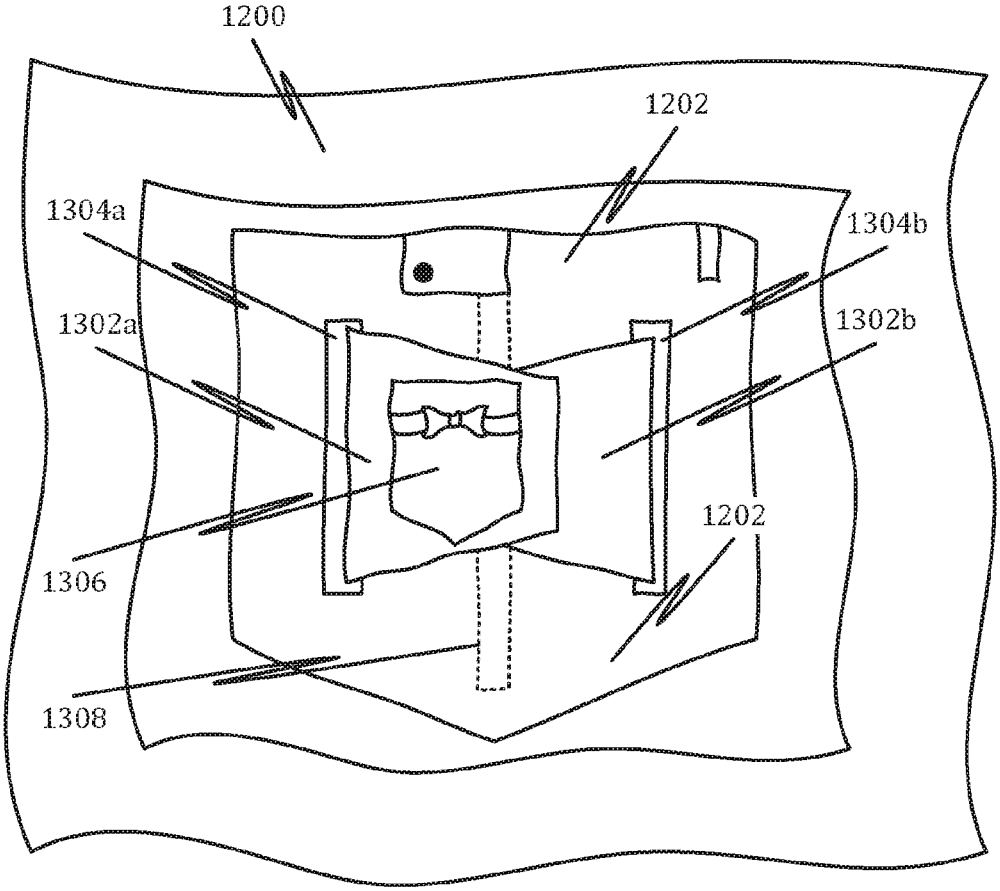
FIG. 13 illustrates a multi-use blanket including a pair of safety wrap flaps in accordance with various embodiments.

In some embodiments, the multi-use blanket 1200 may include a pair of safety wrap flaps 1302, such as a left safety wrap flap 1302*a* and a right safety wrap flap 1302*b* as illustrated in FIG. 13. Further, a first end of each safety wrap flap 1302 may be attached to the front part of the multi-use blanket 1200. Additionally, the pouch 1202 may include a pair of openings 1304 illustrated as 1304*a* and 1304*b* illustrated both in FIG. 13 and FIG. 14*b*. An opening 1304 may be configured to receive a second end of a safety wrap flap 1302.

Figure 14A:
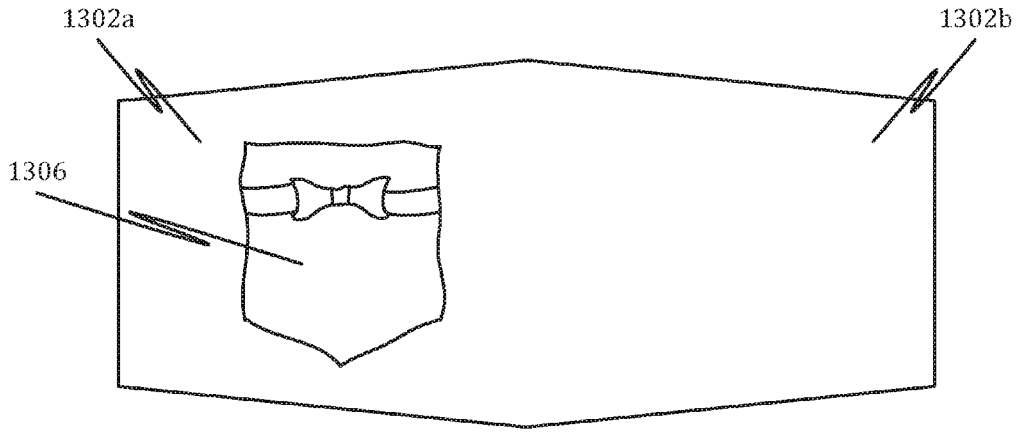
FIG. 14*a* illustrates parts of a multi-use blanket including a pair of safety wrap flaps in accordance with various embodiments.
Figure 14B:
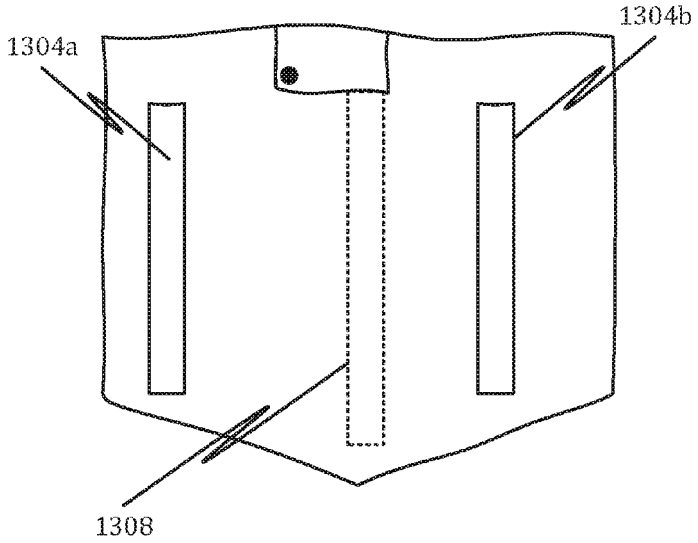
FIG. 14*b* is another illustration of parts of a multi-use blanket including a pair of safety wrap flaps in accordance with various embodiments.

In some embodiments, each of the left safety wrap flap 1302*a* and 1302*b* may form a single fabric as illustrated in FIG. 14*a*. Accordingly, the pair of safety wrap flaps 1302 may slide from side to side when pulled.

Further, the multi-use blanket 1200 may include a fastener (not shown in figure) configured to fasten the second end of a first safety wrap flap, such as 1302*a* with the second end of a second safety wrap flap, such as 1302*b*. In addition, in some embodiments, the multi-use blanket 1200 may include a fastener 1308 such as a zipper.

In some embodiments, the multi-use blanket 1200 may further include a pocket 1306 attached to a front part of one or more of the first safety wrap flap 1302*a* and the second safety wrap flap 1302*b*. Further, the pocket 1306 may be configured to accommodate one or more objects.

Figure 15:
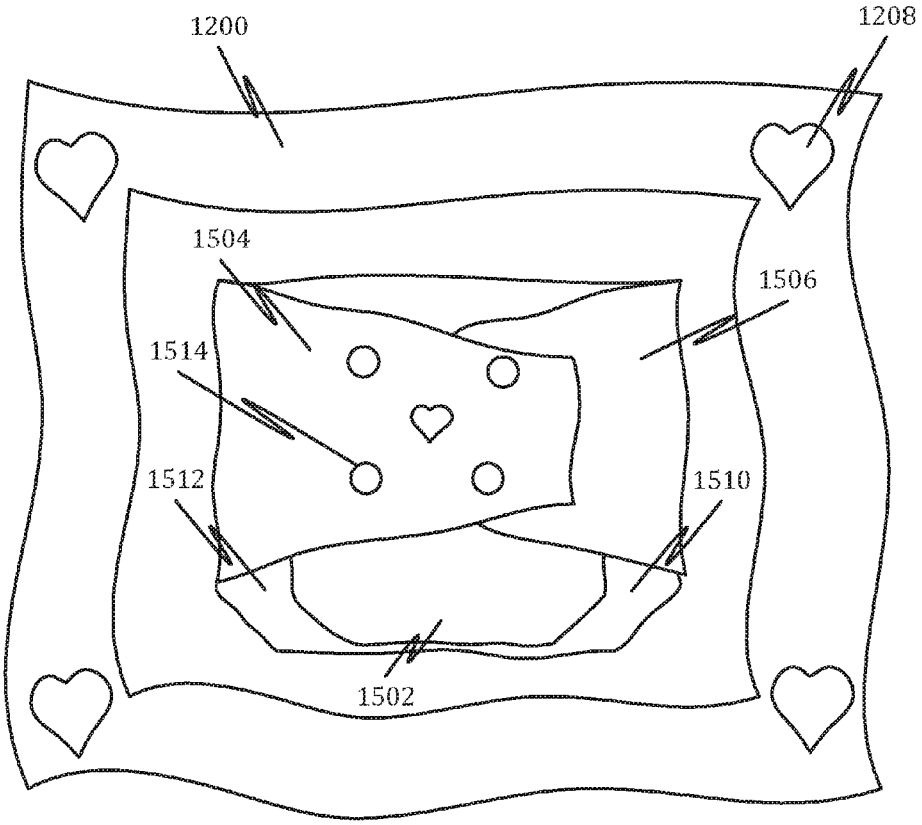
FIG. 15 illustrates a multi-use blanket including a diaper in accordance with various embodiments.

In some embodiments, the multi-use blanket 1200 may include a diaper 1502 attached to a front part of the multi-use blanket 1200 as illustrated in FIG. 15. The diaper 1502 may include each of a center fold 1504, a left fold 1506, a right fold 1508, a right leg opening 1510, a left leg opening 1512 and a fastener 1514 configured to fasten the left fold 1506 to the right fold 1508. The fastener 1514 may be one of a Velcro fastener and snap-button based fastener.

III. Claims

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

Insofar as the description above and the accompanying drawing disclose any additional subject matter that is not within the scope of the claims below, the disclosures are not dedicated to the public and the right to file one or more applications to claims such additional disclosures is reserved.

The following is claimed:

1. A multi-use garment comprising:

a torsal portion configured to be worn over a torso having a bottom edge configured to be adjacent a waist of a wearer when worn;

a pair of sleeve portions attached to the torsal portion, wherein each sleeve portion is configured to accommodate at least a part of an arm;

a pair of separate leg portions attached to the torsal portion, wherein each leg portion is configured to accommodate at least a part of a leg, wherein each leg portion has a first end adjacent the torsal portion and a second end remote from the torsal portion;

a pair of fasteners attached to the second end of each of the pair of leg portions, wherein each fastener is configured to create a completely closed bottom edge of the torsal portion;

wherein each fastener of the pair of fasteners is at least one of the following: a zipper, a snap button fastener, a hook and loop fastener, a drawstring, a pair of drawstrings; and wherein each fastener of the pair of fasteners is configured to create a completely closed bottom edge of the torsal portion so that, in one configuration of the multi-use garment, each leg portion is entirely drawn into an inner space of the torsal portion thus closing off the entire bottom edge of the multi-use garment wherein nothing projects from the bottom edge of the multi-use garment and the multi-use garment is capable of being used as a storage bag or a sleeping bag.

2. The multi-use garment of claim 1, wherein the torsal portion comprises each of a front part and a rear part, wherein at least one of the front part and the rear part comprises a further fastener.

3. The multi-use garment of claim 2, wherein the rear part comprises the further fastener, wherein one end of the further fastener is located at an upper periphery of the rear part, wherein the fastener is a zipper.

4. The multi-use garment of claim 1 further comprising at least one drawstring, wherein a size of the torsal portion is based on a state of the at least one drawstring.

5. The multi-use garment of claim 4 comprising a pair of drawstrings, wherein each drawstring is located along a side of the torsal portion, wherein a length of the torsal portion along the side is based on a state of the corresponding drawstring.

6. The multi-use garment of claim 1 further comprising each of at least one belt and at least one button attached to the torsal portion, wherein the at least one belt comprises at least one hole configured to fasten the at least one belt with the at least one button, wherein a size of the torsal portion is based on fastening of the at least one belt to the at least one button.

7. The multi-use garment of claim 1 further comprising at least one pocket attached to an outer surface of at least one of the front part of the torsal portion and the rear part of the torsal portion.

8. The multi-use garment of claim 1 further comprising a collar portion.

9. A multi-use garment comprising:

a torsal portion configured to be worn over a torso having a bottom edge configured to be adjacent a waist of a wearer when worn;

a pair of sleeve portions attached to the torsal portion, wherein each sleeve portion is configured to accommodate at least a part of an arm;

a pair of separate leg portions attached to the torsal portion, wherein each leg portion is configured to accommodate at least a part of a leg, wherein each leg portion has a first end adjacent the torsal portion and a second end remote from the torsal portion;

a pair of fasteners attached to the bottom edge of the torsal portion adjacent the first end of each of the leg portions;

wherein each fastener of the pair of fasteners is configured to create a completely closed bottom edge of the torsal portion so that, in one configuration of the multi-use garment, each leg portion is entirely drawn into an inner space of the torsal portion thus closing off the entire bottom edge of the multi-use garment wherein nothing projects from the bottom edge of the multi-use garment and the multi-use garment is capable of being used as a storage bag or a sleeping bag;

wherein each fastener is at least one of the following: a zipper, a snap button fastener, a hook and loop fastener, a drawstring, a pair of drawstrings.

* * * * *